US006843690B2

(12) United States Patent
Sauer et al.

(10) Patent No.: US 6,843,690 B2
(45) Date of Patent: Jan. 18, 2005

(54) CONTACT DEVICE FOR HEARING AIDS

(75) Inventors: Joseph Sauer, Strullendorf (DE); Christian Schmitt, Grossenseebach (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 0 days.

(21) Appl. No.: 10/405,853

(22) Filed: Apr. 2, 2003

(65) Prior Publication Data

US 2003/0199204 A1 Oct. 23, 2003

(30) Foreign Application Priority Data

Apr. 2, 2002 (DE) ..... 102 14 542

(51) Int. Cl.[7] ..... H01R 9/22
(52) U.S. Cl. ..... 439/722; 439/736
(58) Field of Search ..... 439/500, 606, 439/722, 736; 29/883, 884; 264/272.11

(56) References Cited

U.S. PATENT DOCUMENTS 2,766,436 A * 10/1956 Luebking ..... 439/722
4,195,893 A * 4/1980 Stupay ..... 439/497

FOREIGN PATENT DOCUMENTS

EP 0 988 776 3/2001

* cited by examiner

*Primary Examiner*—Tho D. Ta
(74) *Attorney, Agent, or Firm*—Schiff Hardin LLP

(57) ABSTRACT

For miniaturizing and rationalizing the manufacturing process of contact devices for herring aids, it is proposed that an injection molded body be provided with metal contact springs according to the insert mold technology. Over and above this, wiring elements are applied on the injection molded body as interconnects. To this end, the injection molded plastic body provided with metal springs can be activated in specific patterns with, for example, a laser, and, subsequently, the activated portions are coated with conductive metal. Alternatively, the interconnects can also be printed onto the injection molded body.

10 Claims, 1 Drawing Sheet

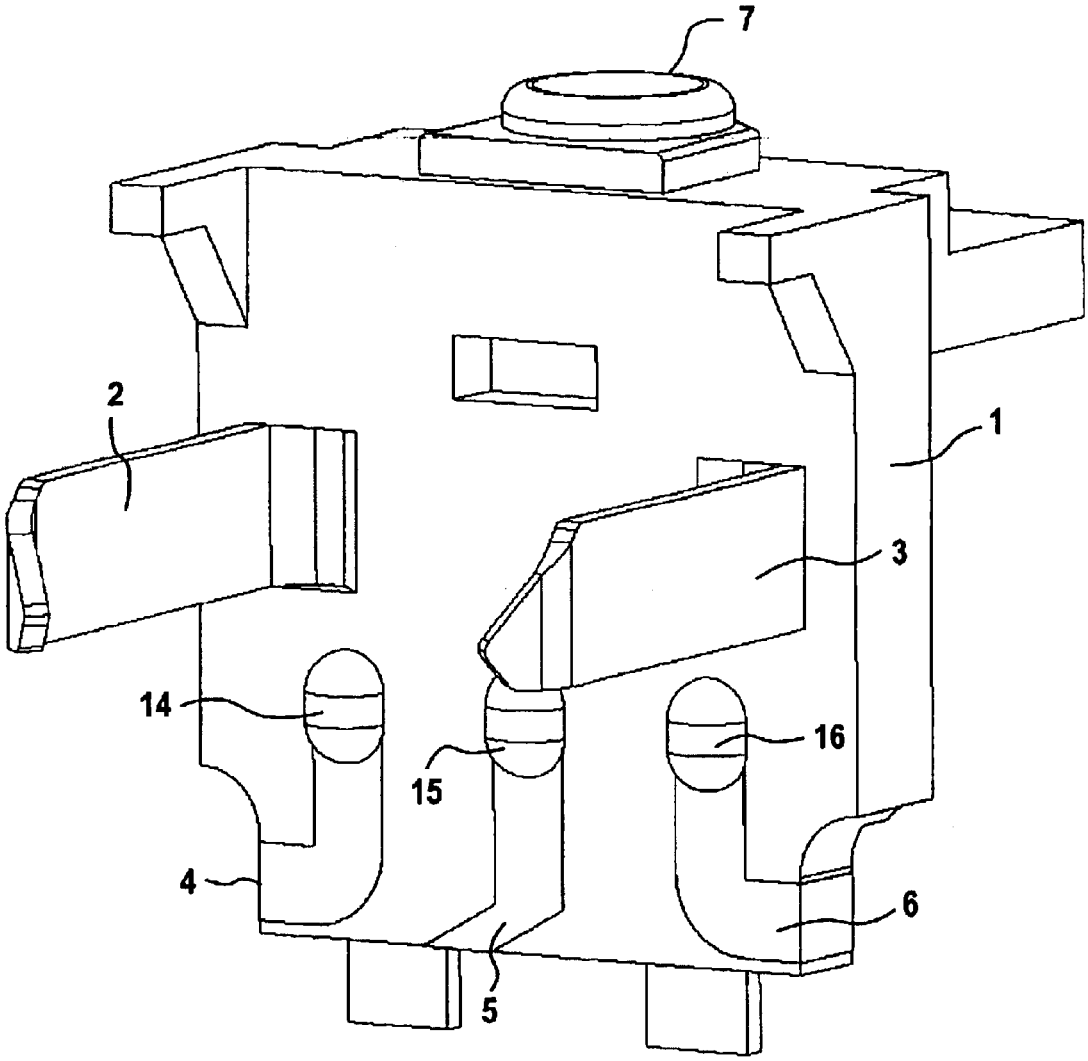
FIG

CONTACT DEVICE FOR HEARING AIDS

BACKGROUND OF THE INVENTION

1. Field of the Invention

The present invention is directed to a device for contacting electrical components of a hearing aid with an injection molded plastic body for carrying contact elements and at least one metal contact element that is injected into the injection molded plastic body. The present invention is also directed to a method for manufacturing such a device.

2. Description of the Related Art

The electrical components of a hearing aid must be suitably contacted in the hearing aid housing. To this end, European Patent EP 0 988 776 B1 discloses a contacting device that comprises connections to an electrical module. Over and above this, metal spring elements are attached to the contacting device for contacting a hearing aid battery and for holding the device in the cover plate of the hearing aid.

It is known methodologically in this context from "insert mold technology" to place stamped metal parts and wire connector elements into plastic injection molds in order to co-inject these into the plastic body in the injection molding process. The contact locations are given well-defined positions using the injection molded body.

The injection molded body can also be used for carrying electronic components in the hearing aid using its contact elements. Nonetheless, further wire connections that cannot be realized as metal contact elements injected into the plastic body are required for contacting some components of the hearing aid.

SUMMARY OF THE INVENTION

The object of the present invention is to miniaturize elements and devices needed for the contacting and to make their fabrication more efficient.

This object is inventively achieved by a device for contacting electrical components of a hearing aid with an injection molded plastic body for carrying contact elements and at least one metal contact element that is injected into the injection molded plastic body, as well as by at least one wiring element that is applied onto the surface of the injection molded plastic body in an interconnect-like manner.

A method is likewise inventively provided for manufacturing an above device by placing the at least one metal contact element into an injection mold for the injection molded plastic body, filling the injection mold with an insulating plastic and printing interconnects onto the injection molded plastic body.

DESCRIPTION OF THE DRAWING

The present invention is explained below in greater detail on the basis of the attached drawing, which is a perspective view showing an inventive contact device.

DETAILED DESCRIPTION OF THE PREFERRED EMBODIMENTS

The following exemplary embodiments, however, are not intended to limit the scope of the invention.

Various embodiments of the invention may be envisioned. In turns of fabrication technology, the metal contact elements that are to be injected into the injection molded plastic body may be beneficially punched from sheet metals. Insofar as the metal contact elements are intended to exert pressure onto the components to contacted, metal springs can be used for this.

Wiring elements that represent interconnects on the injection molded plastic body can be inventively employed not only for connecting injected metal contact elements to one another but can also be employed for producing contacts toward the outside. Thus, it is advantageous to equip the wiring elements with contact locations that project from the surface of the injection molded plastic body and thus offer a good electrical contacting possibility to components that need not be formed with resilient metal contacts.

When activated plastic structure elements are used in the manufacture, the wiring elements or interconnects are arranged over the parts of the structure elements that project to the surface of the injection molded body. For activation, the plastic for the injection of the plastic elements is beneficially doped with palladium.

The electronics modules and batteries of a hearing aid are preferably contacted by the inventive contact devices. These can be in-the-ear hearing aids as well as behind-the-ear hearing aids.

The manufacture of the inventive contact devices preferably ensues by inserting corresponding contact elements, which comprise metal contact elements and structure elements of plastic, into an injection mold, as was already presented above as insert mold technology. To that end, the necessary structure elements are first injected in their three-dimensional form from, for example, a plastic activated with palladium. Subsequently, these injected structure elements together with the further metal contact elements or metal springs are introduced into the injection mold for the molded body. Subsequently, the injection mold with the metal contact and structure elements is filled with insulating plastic. Finally, the activated structure elements—insofar as they project from the surface—are coated with metal, for example, in a bath.

Interconnect technology usually allows the contact locations at which contact difficulties can occur to be reduced, which leads to a further enhancement of the quality of the contact device. In case of manufacture with insert mold technology, further, insert parts can be saved in that the contact locations for external contacts are applied to the structure elements. The number of parts needed for the fabrication is thus reduced, the assembly time being is also shortened, and the degree of automation for the fabrication is capable of being increased.

As already mentioned, a miniaturization is also possible in that interconnects are applied onto the injection molded body. To this end, those locations that carry interconnects can, on the one hand, be activated with a laser, and the activated locations on the plastic body can be subsequently coated with metal. On the other hand, however, the interconnects can be also applied onto the injection molded body by arbitrary printing methods.

Additionally, an embodiment of the invention is provided by a method for manufacturing such a device by injection molding at least one structure element composed of an activated plastic that, in particular, is activated with palladium, placing the at least one structure element together with the at least one metal contact element into an injection mold, injection-molding around the at least one structure element and the at least one metal contact element with an insulating plastic to form an injection molded plastic body, where the structure element projects at least partly to the surface of the injection molded plastic body, resulting in a surface region being defined, and metallization of the surface region of the injection molded plastic body defined by the structure element.

An embodiment also includes a method for manufacturing the above device by placing the at least one metal contact element into an injection mold for the injection molded plastic body, filling the injection mold with an insulating plastic, irradiating an interconnect pattern on the surface of the injection molded plastic body and coating the irradiated pattern with a conductive metal.

The FIGURE shows an injection molded plastic body 1. Metal springs 2 and 3 are injected into this, these metal springs 2 and 3 serving in the present case for contacting a hearing aid battery (not shown). Furthermore, structure elements are injected into the contacting device 1 under the interconnects or wiring elements 4, 5 and 6. Each of these wiring elements 4, 5, 6 has a contact location 14, 15, 16 that projects from the surface of the injection molded body 1.

For manufacturing the injection molded body 1, the structure elements are fabricated of activated plastic, are placed into the injection mold together with the metal springs 2, 3, and have insulating plastic injection molded around them.

The contacting device shown in the drawing can also be manufactured in that only the metal springs 2 and 3 are at first injected into the body 1 according to the known insert mold method. Subsequently, tracks are activated with a laser for the wiring elements on the surface of the injection molded body 1. These activated tracks are subsequently coated with a conductive metal. Alternatively, the interconnects can be printed onto the injection molded body.

An electronic module with microphone that can be arranged at what is the back side with reference to the illustration of the drawing can be contacted, for example, by the wiring elements 4, 5, 6. The sound opening 7 for a microphone is visible at the upper side of the injection molded plastic body 1.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

The particular implementations shown and described herein are illustrative examples of the invention and are not intended to otherwise limit the scope of the invention in any way. Moreover, no item or component is essential to the practice of the invention unless the element is specifically described as "essential" or "critical". Numerous modifications and adaptations will be readily apparent to those skilled in this art without departing from the spirit and scope of the present invention.

LIST OF REFERENCE CHARACTERS

| | |
|---|---|
| 1 | injection molded body |
| 2 | metal contact element |
| 3 | metal contact element |
| 4 | wiring element |
| 5 | wiring element |
| 6 | wiring element |

-continued

LIST OF REFERENCE CHARACTERS

| | |
|---|---|
| 7 | sound opening |
| 14 | contact location |
| 15 | contact location |
| 16 | contact location |

What is claimed is:

1. A device for contacting electrical components of a hearing aid, comprising:

contact elements;

an injection molded plastic body configured to carry the contact elements;

at least one metal contact element of the contact elements that is injected into the injection molded plastic body; and at least one wiring element that is applied onto a surface of the injection molded plastic body in an interconnect-like manner for wiring at least one of the electrical components and the at least one metal contact element.

2. The device according to claim 1, wherein the at least tone metal contact element is a punched metal part.

3. The device according to claim 1, wherein the at least one metal contact element is a metal spring.

4. The device according to claim 1, wherein the at least one wiring element comprises at least one contact location for contacting an electrical component, the at least one contact location being raised over the surface of the injection molded plastic body.

5. The device according to claim 1, wherein the at least one wiring element has a substrate that is a plastic section doped with palladium.

6. The device according to claim 1, wherein two metal contact elements for contacting a hearing aid battery and a plurality of wiring elements for contacting a hearing aid electronics module are arranged at the injection molded plastic body.

7. A hearing aid comprising a device for contacting electrical components according to claim 1.

8. The device according to claim 1, wherein the device is a part of a hearing aid.

9. The device according to claim 1, wherein the at least one wiring element is applied so that a metallic portion of the wiring element directly contacts the surface of the injection molded plastic body and is for some portion of its length parallel to the surface.

10. A device for contacting electrical components of a hearing aid, comprising:

contact elements;

an injection molded plastic body configured to carry the contact elements;

at least one metal contact element of the contact elements that is injected into the injection molded plastic body; and at least one wiring element that is applied onto a surface of the injection molded plastic body in an interconnect-like manner for wiring at least one of the electrical components and the at least one metal contact element;

wherein the at least one wiring element comprises at least one contact location for contacting an electrical component, the at least one contact location being raised over the surface of the injection molded plastic body; and wherein the at least one wiring element has a substrate that is a plastic section doped with palladium.

* * * * *